United States Patent [19]

Lymburner

[11] Patent Number: 4,899,626

[45] Date of Patent: Feb. 13, 1990

[54] BOLT OR STUD MOUNTING AND EXTRACTING TOOL

[76] Inventor: Kenneth Lymburner, R.R. 1, Box 106, Osage, Minn. 56570

[21] Appl. No.: 392,703

[22] Filed: Aug. 11, 1989

[51] Int. Cl.[4] ..... B25B 13/50

[52] U.S. Cl. ..... 81/53.2; 81/128; 279/30

[58] Field of Search ..... 81/53.2, 90.1–90.4, 81/94–96, 124.2, 59.1, 128; 279/1 TE, 30, 33, 35, 71, 72, 81

[56] References Cited

U.S. PATENT DOCUMENTS

| | | | |
|---|---|---|---|
| 854,169 | 5/1907 | Jones . | |
| 2,027,534 | 1/1936 | Ingersoll | 81/53 |
| 2,063,344 | 12/1936 | Schneider | 279/72 |
| 2,105,788 | 1/1938 | Hess | 81/53 |
| 2,560,012 | 7/1951 | Valvano | 81/53.2 |
| 2,613,942 | 10/1952 | Sanndens | 279/72 |
| 2,771,805 | 11/1956 | Jacobson | 81/53.2 |
| 3,889,557 | 6/1975 | Young | 81/53.2 |

*Primary Examiner*—D. S. Meislin

*Attorney, Agent, or Firm*—James V. Harmon

[57] ABSTRACT

The invention provides a bolt or stud mounting and extracting tool having a tool body with a stud receiving recess therein that includes a longitudinal axis which is parallel during operation with the stud that is being removed. The recess has an oval interior which is smoothly contoured internally. The recess is free from multiple diverging pockets separated from one another by centrally projecting shoulders, making it easy to manufacture. The oval interior of the tool is elongated transversely on a lateral axis perpendicular to its longitudinal axis. The recess has a concave stud-engaging contact surface at one end of the lateral axis that engages an extended portion of the stud and a second concave roller-engaging surface at the other end of the lateral axis to engage a gripping roll aligned with the stud in the recess. The roll-engaging surface is contoured to force the gripping roll against the stud when the tool is rotated about the stud. The recess is closed at one end. A curved channel in the closed end of the recess receives one end of the roll and a retaining plate at the open end of the recess holds the roll in place.

4 Claims, 1 Drawing Sheet

BOLT OR STUD MOUNTING AND EXTRACTING TOOL

FIELD OF THE INVENTION

The present invention relates to tools and more particularly a tool for mounting or extracting bolts, studs and the like and especially stuck or broken wheel studs.

BACKGROUND OF THE INVENTION

Heavy vehicles for use off or on the road and particularly the largest size semi-trailers and tractors employ wheel studs or lugs which all too often become stuck, broken or damaged and are difficult to remove. One common problem occurs with the Budd-style lug bolt or stud which is hollow and is held in place with a retaining bolt mounted from the brake drum portion of the wheel. Tools heretofore available for removing studs of this kind were likely to become broken or were ineffective in operation. One prior stud extractor is constructed to make point contact with the stud, for example by using fixed teeth or jaws. In one tool of this type two hardened steel jaws were mounted on the inside of the stud receiving opening. Jaws of this kind tend to slip because point contact allows abrasion of metal forming the surface of the stud. Another type of extractor has a plurality of rolls, e.g. three rolls, each mounted in a ramp or cam track spaced evenly around the stud. Here again, the tool makes point contact with the stud. The point contact allows metal to be scraped from the surface of the stud, enabling it to slip when torque is applied to the tool. This is especially true when the surface of the stud is covered with screw threads.

A further disadvantage of prior tools is the complex shape of the opening used to receive the stud. Forming such an opening can require several successive machining operations. This makes the tool expensive to produce. A further shortcoming is that gripping rollers previously proposed can become cocked, misaligned and/or stuck in position and therefore will not operate properly.

In view of these deficiencies of the prior art it is an objective of the invention to provide a tool of the type described which has a single smoothly contoured recess that lends itself to high-speed automated production and which holds both the stud and a gripping roll for engaging the stud.

Another object is to provide a tool with a contoured wall that engages the stud over a large portion of its surface so that the stud can be held over an extended area approximating one-half of its surface, thereby allowing it to be pressed more firmly against the gripping roll to reduce slippage.

Yet another object of the invention is to provide a gripping roll with extended flat alignment surfaces on each end to reliably hold the gripping roll in place so that it will move freely within its opening, ready to engage the broken or stuck stud when pressure is applied to the tool.

SUMMARY OF THE INVENTION

The invention provides a bolt or stud mounting and extracting tool having a tool body with a stud receiving recess therein that includes a longitudinal axis which is parallel during operation with the stud that is being removed. The recess has an oval interior which is smoothly contoured internally. The recess is free from multiple diverging pockets separated from one another by centrally projecting shoulders, making it easy to manufacture. The oval interior of the tool is elongated transversely on a lateral axis perpendicular to its longitudinal axis. The recess has a concave stud-engaging contact surface at one end of the lateral axis to engage an extended portion of the stud and a second concave roller-engaging surface at the other end of the lateral axis to engage a gripping roll aligned with the stud in the recess. The roll-engaging surface is contoured to force the gripping roll against the stud when the tool is rotated about the stud. The recess is closed at one end. A curved channel in the closed end of the recess receives one end of the roll and a retaining plate at the open end of the recess holds the roll in place.

THE FIGURES

DESCRIPTION OF A PREFERRED EMBODIMENT

Figure 1:
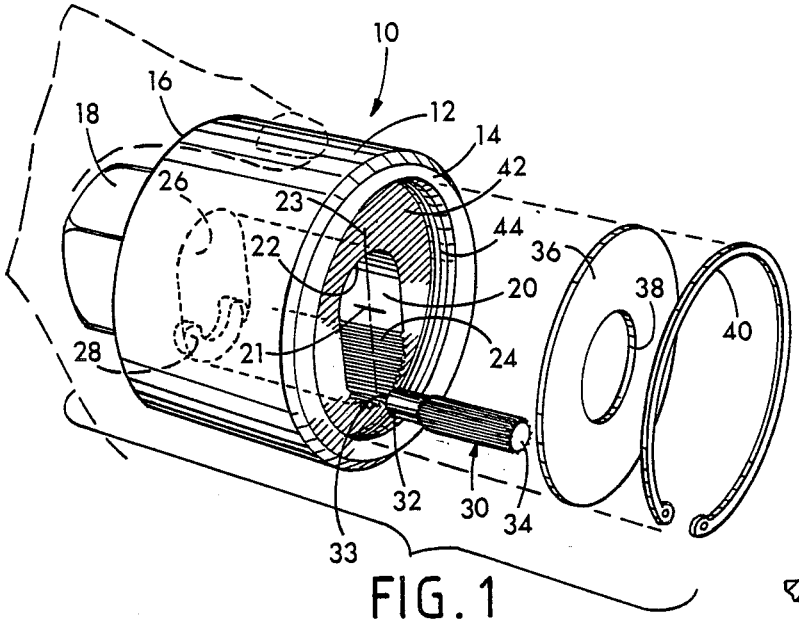
FIG. 1 is an exploded perspective view of the invention.
Figure 2:
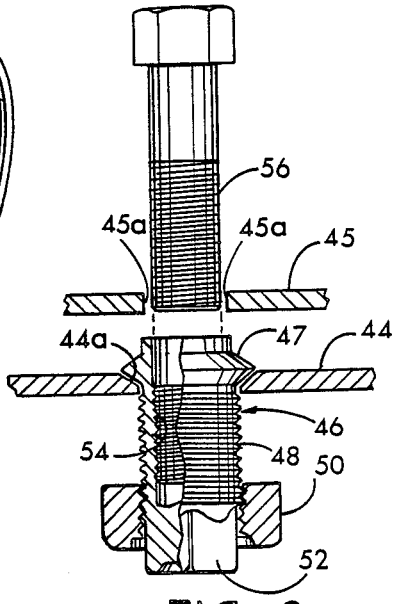
FIG. 2 is a horizontal sectional view showing a typical retaining bolt and stud of the type to be removed with the tool.
Figure 3:
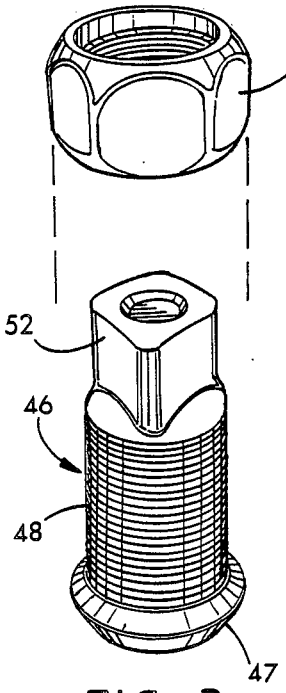
FIG. 3 is a perspective view of a stud and wheel nut.

Shown in the figures is a bolt or stud mounting and extracting tool indicated generally by the numeral 10. Tool 10 is generally cylindrical in shape and includes an outer side wall 12 and a flat end wall 14 with a central depression 42 surrounded by a groove 44 for a snap ring 40 which is used to hold a retaining plate 36 within the depression 42. In the depression 42 is a recess 20 which is generally oval in cross-section. The recess 20 is open at its right end and extends inwardly toward the opposite end of the tool 10. It is closed at its inner end 26 adjacent the left end of the tool 16 as seen in FIG. 1. A drive head 18 is provided on the end 16 of the tool 10 to allow a wrench to be attached for rotating the tool about a central longitudinal axis 21. The recess 20 is elongated along a transversely disposed lateral axis 23 to give the recess 20 an oval interior shape.

Figure 4:
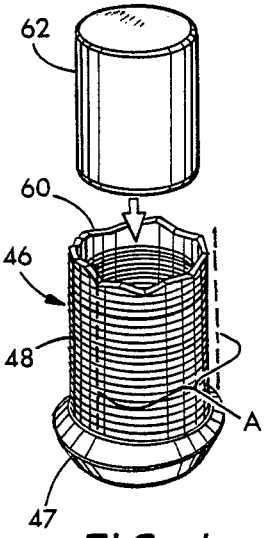
FIG. 4 is a perspective view of a broken stud showing a drive pin being inserted.
Figure 5:
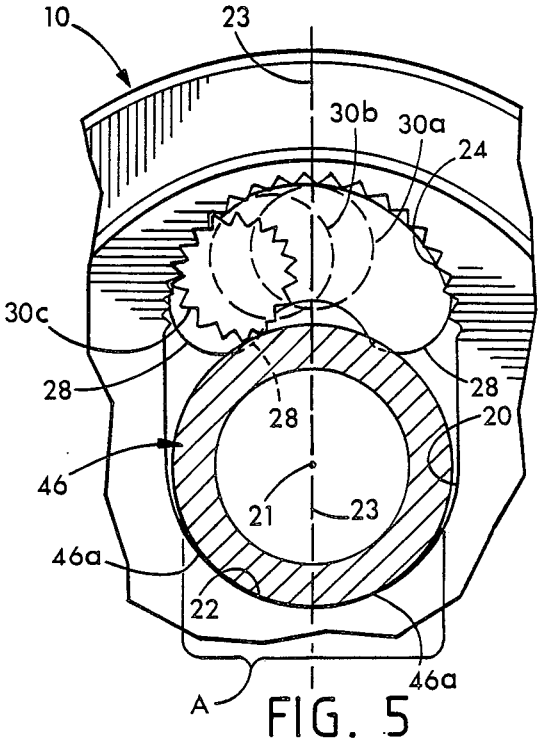
FIG. 5 shows a cross-section of the tool and broken stud with the gripping roll in three alternate positions.

As shown in FIG. 5, the recess 20 has a concave stud-engaging contact surface A at one end of lateral axis 23 which engages the stud 46 over a substantial portion of its surface. The contact surface A can be generally hemicylindrical in shape to conform to the surface of the stud 46 in the general area A′ between dashed lines of FIG. 4.

The recess 20 also includes an inner curved roll-engaging surface 24 at the opposite end of the transverse axis 23 from contact surface A. The roll-engaging surface 24 is concavely curved. It is furthest from the axis 21 at the intersection of the axis 23 and on either side thereof it curves in an arc toward the axis 21 of the recess 20 so as to force the roll 30 into engagement with the stud 46 when the tool is rotated in either direction. The roll-engaging curved wall portion 24 of the recess 20 can be provided with longitudinally extending alternate ridges and grooves or serrations to mate with similar serrations in the roll 30 to assist in forcing the roll tightly into engagement with the stud 46.

It can be seen that the interior wall of the recess 20 is smoothly contoured internally and is thereby free from multiple diverging pockets separated from one another by centrally extending shoulders or other projections of the type used in prior tools. The inside walls of the recess 20 between the curved surfaces 22 and 24 can be flat or slightly curved, if desired. The tool can, however, be manufactured most efficiently if the connecting surfaces are flat.

Mounted in the recess 20 is a longitudinally extending gripping roll 30. The gripping roll 30 is held in place by the retaining plate 36 which has a central opening 38 aligned with the longitudinal axis 21. The gripping roll 30 is provided at each end with extended flat alignment surfaces normal to the axis thereof. The inner flat alignment surface 33 rests in close proximity with a flat end surface of an arc-shaped channel 28. Thus it will be seen that the curved channel 28 is located in the inner end wall of the recess 20 adjacent to the roll-engaging surface 24. The width of the curved channel 28 is great enough to accommodate the entire end of roll 30. The outer alignment surface 34 makes a sliding fit with the inner surface of the retaining plate 36. In this way the flat alignment surfaces 33, 34 hold the roll 30 in alignment with the recess 20. The concave inner surfaces 22 and 24 of the recess are preferably both hemicylindrical.

While the invention is useful in connection with mounting or extracting cylindrical objects in general, it is particularly useful in connection with removing broken Budd-style studs from the wheels of on-the-road or off-the-road vehicles. In this application, the stud 46 is bolted in place on a wheel and brake assembly or brake drum 45 of the vehicle by means of a retaining bolt 56 that is screw threaded into the threads 54 that line the open center of the stud 46. In this way the stud 46 serves as a lug bolt which with lug nut 50 holds the wheel 44 on the vehicle. If the stud is broken or stuck in place, the tool 10 is placed over the stud 46. As shown in FIG. 5, a large portion, about one-half, of the stud 46 engages the contact surface A. When the tool is turned in either direction the gripping roll 30 will move from an intermediate loose position **30*a* toward one side where the roll-engaging surface 24 will force it slightly at first as shown at 30*b* into proximity with the stud 46 and finally, as shown at 30*c*, into tight engagement with the stud 46. Since the stud 46 is engaged over a large portion of its contact surface A, it has little likelihood of slipping when the tool 10** is turned.

If the stud 46 is broken, as at 60 in FIG. 4, it is preferred that a drive pin 62 be inserted into the broken stud 46 to prevent the stud from collapsing due to the extreme pressure produced by the roll at **30*c***.

The tool 10 has proved to be rugged in construction, reliable in operation and can be produced with a minimum of manufacturing steps, thereby reducing production costs. The tool can be used with an ordinary wrench or an impact wrench if desired, and because the stud is engaged over a substantial surface area, the possibility of tool slippage is almost entirely eliminated.

Many variations of the present invention within the scope of the appended claims will be apparent to those skilled in the art once the principles described herein are understood.

What is claimed is:

1. A bolt or stud mounting and extracting tool comprising, a tool body having a stud receiving recess therein, said recess having a longitudinal axis which is parallel during operation with the stud, said recess being adapted at one end to receive the stud, the recess has a smoothly contoured interior surface, said interior surface being in the form of an oval in a plane extending perpendicular to the longitudinal axis of the recess, said interior surface having a concave stud-engaging area at one end of a lateral axis to engage an extended portion of the surface of the stud and a concave roll-engaging surface at the other end of the lateral axis, a longitudinally extending gripping roll mounted within the recess in engagement with the roll-engaging surface, said roll-engaging surface being spaced furthest from the longitudinal axis at the intersection with the lateral axis and gradually approaching the longitudinal axis on either side of the lateral axis to force the gripping roll against the stud when the tool is turned, substantially flat connecting surfaces joining the concave surfaces, and a retaining plate member for holding the gripping roll within the recess.

2. The apparatus of claim 1 wherein the recess includes an arc-shaped roll receiving channel in an inner end wall opposite said open end, the roll includes flat alignment surfaces at each end thereof normal to the roll axis, one alignment surface engages an end wall within the channel and the other alignment surface engages the retaining plate whereby the roll is held in alignment within the recess.

3. The apparatus of claim 1 wherein said roll has flat alignment surfaces at each end normal to a roll axis, the recess includes an inner end wall having a curved channel adjacent to the stud engaging surface, the width of the curved channel is great enough to accommodate the entire end of the roll therein whereby the flat alignment surfaces on the ends of the roll hold the roll in alignment with the recess.

4. The apparatus of claim 1 wherein the stud engaging concave inner area of the interior surface of the recess and the concave roller engaging surface of the interior surface of the recess are both hemicylindrical surfaces joined together by substantially flat parallel longitudinally extending connecting surface and the roller engaging surface and roller are provided with longitudinal serrations.

* * * * *